US007152652B2

(12) United States Patent
Heitel

(10) Patent No.: US 7,152,652 B2
(45) Date of Patent: Dec. 26, 2006

(54) LOAD DETECTION SYSTEM FOR MOTORIZED LATERAL AND VERTICAL ARM AWNINGS

(75) Inventor: Robert G. Heitel, Laguna Beach, CA (US)

(73) Assignee: Girard Systems, San Clemente, CA (US)

( * ) Notice: Subject to any disclaimer, the term of this patent is extended or adjusted under 35 U.S.C. 154(b) by 198 days.

(21) Appl. No.: 10/945,452

(22) Filed: Sep. 20, 2004

(65) Prior Publication Data

US 2006/0060307 A1 Mar. 23, 2006

(51) Int. Cl.
*E05F 15/20* (2006.01)

(52) U.S. Cl. ..... 160/5; 160/22; 160/66; 160/310

(58) Field of Classification Search ..... 160/22, 160/66, 1, 5, 7, 310, 311, 312, 188, 189; 135/88.11, 88.12
See application file for complete search history.

(56) References Cited

U.S. PATENT DOCUMENTS 1,791,151 A * 2/1931 Tarvid ..... 160/5
3,802,479 A * 4/1974 Newell et al. ..... 160/1
5,225,748 A 7/1993 Haring
6,111,376 A 8/2000 Jean-Marc
6,142,209 A 11/2000 Girard
6,484,069 B1 * 11/2002 Osinga ..... 700/275
6,581,664 B1 6/2003 Kröner et al.
6,798,158 B1 * 9/2004 Evans ..... 318/266

* cited by examiner

*Primary Examiner*—David Purol
(74) *Attorney, Agent, or Firm*—Walter A. Hackler

(57) ABSTRACT

A load detection system for lateral and vertical arm awnings generally includes a motorized roller with a fabric wound thereabout in a retracted position and extendable therefrom. Arms are provided for supporting the fabric in an extended position and at least one sensor is utilized for sensing strain due to extended awning loading and producing a load signal corresponding thereto. A controller is incorporated and responsive to the load signal for causing the motorized roller to retract and extend the fabric.

4 Claims, 2 Drawing Sheets

LOAD DETECTION SYSTEM FOR MOTORIZED LATERAL AND VERTICAL ARM AWNINGS

The present invention is generally related to deployable awnings and is more specifically directed to a load detection system for both lateral and vertical arm awnings in order to prevent damage thereto due to loading, for example, by wind and precipitation.

Retractable lateral arm awnings, for example, are supported by hinged cantilever arms. Such arms include a forearm and elbow and fold up into a housing for compact storage. This system allows for relatively large protected livable areas beneath the awning without the inconvenience of support post.

Vertical arm awnings also provide a sheltered area with the inconvenience of support posts.

In either case, such awnings in effect have large "sail" areas, and wind loading may result in damage to awning structure. Rain can overload the awning structure separately or in combination with the wind. Such force loads may cause large bending stresses on the mounting structure and support arms.

Heretofore, efforts to prevent damage to awnings subjected to wind and rain loading have included the use of anemometers and rain sensors, which are interconnected to control systems for retracting an awning upon the occurrence thereof.

Unfortunately, an anemometer, which must be mounted at a suitable position on a building or recreational vehicle and interconnected to the control system by a cable or wireless link, provides wind conditions which do not usually correspond to the stresses actually experienced by the awning.

It should be evident that the wind conditions at the position of an anemometer are different than the wind conditions in the exact region of the awning. In addition, in adverse conditions the anemometer may seize, or jam. Therefor, there is no direct correlation with the output of an anemometer with stress in an awning deployed nearby.

With regard to rain sensors, a properly installed awning might satisfactory shed the rainfall without accumulating excessive weight and accordingly, a simple rain sensor might cause it to retract.

Accordingly, the present invention provides direct stress information to a control system for retracting and extending an awning from a building or recreational vehicle.

The present invention provides for an apparatus and method for detecting the actual dynamic and static loading on the mounting and support structure of an awning without the need to interpret environmental factors, such as wind speed and precipitation level, which may or may not cause loading of the awning.

SUMMARY OF THE INVENTION

A load detection system for lateral and vertical arm awnings in accordance with the present invention generally includes a motorized roller and a fabric wound about the roller in a retracted position and extendable therefrom.

Arms are provided for supporting the fabric in an extended position and at least one sensor is also provided for sensing strain due to extended awning loading and producing a load signal corresponding thereto.

In communication therewith is a controller, which is responsive to the load signal for causing the motorized roller to retract and extend the fabric.

More particularly, a frame may be provided for supporting the roller and a bracket provided for mounting the fame to a support surface. In one embodiment, at least one sensor for sensing strain in the bracket is provided and provides a bracket load signal corresponding thereto.

Alternatively, or in combination thereof, a sensor for sensing strain may be disposed on at least one arm and produce an arm load signal corresponding thereto. In addition, a sensor may be provided on the frame itself for sensing strain.

Multiple sensors may be provided for sensing strain and a controller is configured for analyzing the strain for retracting and extending the awning.

Still more particularly, the sensors may comprise tensile strain gages, compression strain gages or similar load sensing transducers.

In addition, in order to analyze all parameters associated with strain loading in an awning, an anemometer may be provided for producing a wind signal corresponding to wind velocity and a rain sensor may be utilized for providing a signal corresponding to precipitation. The controller is responsive to the wind signal and rain signal for confirming awning loading. Such information is also useful in determining proper awning installation. That is, if a small amount of rainfall causes an undue loading on the awning, the awning may be improperly installed and not provide for sufficient runoff of precipitation.

Still more particularly, the controller may be responsive to the load signals for causing the motorized roller to retract the fabric to a partially retracted position at which the frame and arms are able to withstand the awning loading without damage and further responsive to the load signals for causing the motorized roller to extend the fabric to a partially extended position at which the frame and arms are able to withstand the awning loading.

It should be appreciated that an algorithm may be developed for the controller for predetermining acceptable load levels on the awning for various deployment positions of the awning.

BRIEF DESCRIPTION OF THE DRAWINGS

The advantages and features of the present invention will be better understood by the following description when considered in conjunction with the accompanying drawings in which.

DETAILED DESCRIPTION

Figure 1:
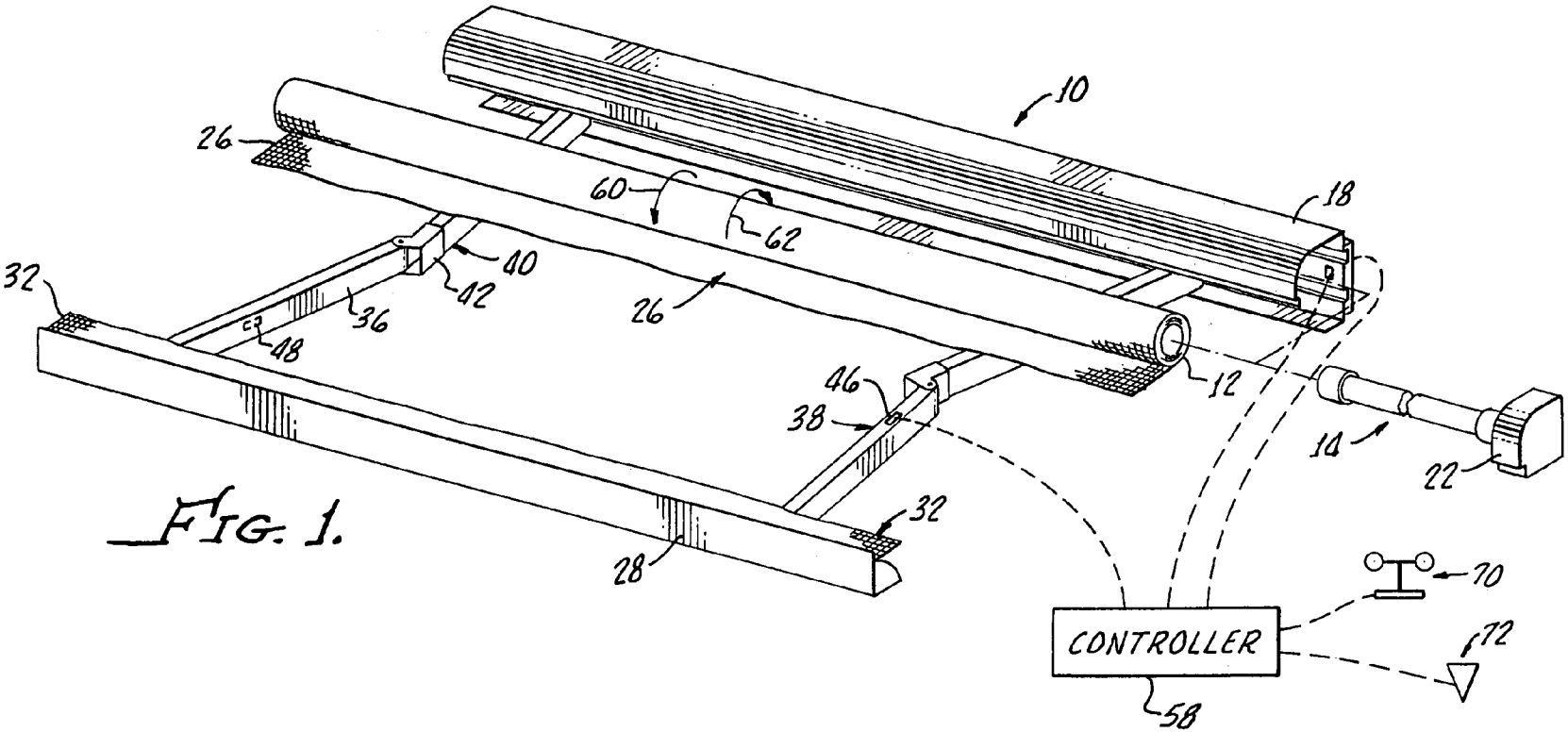
FIG. 1 shows a load detection system in accordance with the present invention for lateral and vertical arm awnings, a lateral arm awning shown as an example, showing a motorized roller with fabric wound around the roller, arms for supporting the fabric, at least one sensor for sensing strain due to extended awning loading and a controller for causing the motorized roller to retract and extend the fabric.

With reference to FIG. 1, there is shown a load detection system 10 in accordance with the present invention including a roller 12 motorized, or powered, by a motor 14 and enclosed by a frame 18 and a motor housing 22.

A fabric, or awning, 26 is wound about the roller 12 and is extendable therefrom as will be hereinafter described in greater detail.

A header 28 attached to an end 32 of the fabric 26 along with arms 36, 38 support the fabric in an extended position. The arm 36 may be articulated through the use of an elbow joint 42 in a conventional manner.

As shown in FIGS. 1–4, sensors 46, 48, 50, 52, 54 of a conventional type are applied to surfaces in a conventional manner for sensing strain due to extended awning loading and produce load signals corresponding thereto.

A controller 58, see FIG. 1, interconnected to the sensors 46–54 and responsive to the load signals causes the motorized roller 12 to retract (see arrow 60) and extend (see arrow 62) the fabric 26 by movement of the arms 36, 38, in a conventional manner. The controller 58 is configured for interpreting the sensor 46–54 load signals and accordingly operating the motor 14.

Figure 2:
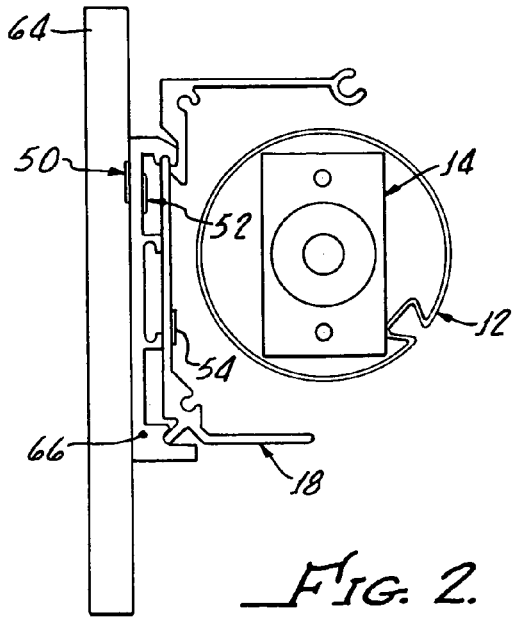
FIG. 2 is a cross sectional view of the load detection system in accordance with the present invention generally showing a motorized roller, frame, and bracket attached to a mounting surface along with various positions of sensors.
Figure 3:
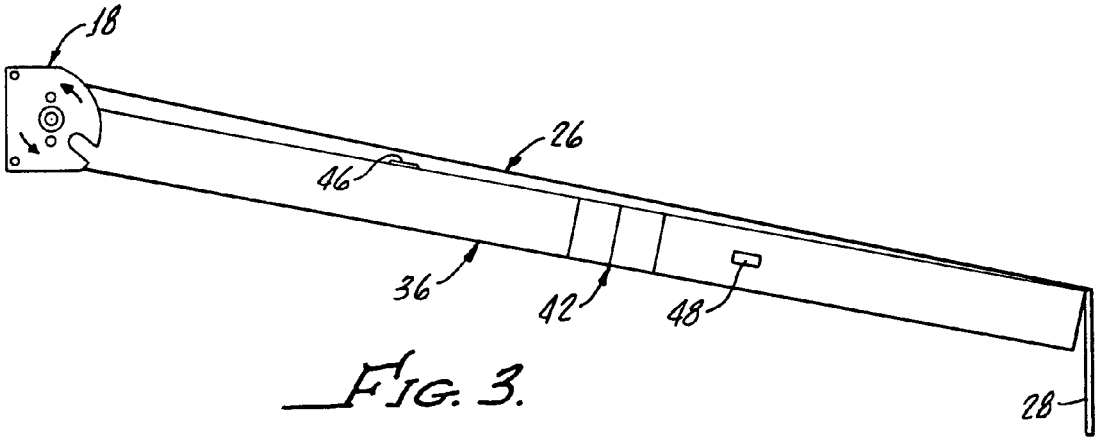
FIG. 3 is a side view of an extended awning and also illustrating alternative positioning of sensors on arms for supporting fabric.
Figure 4:
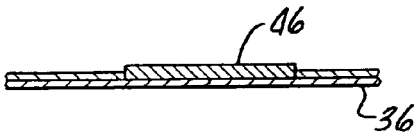
FIG. 4 is a cross sectional view of a strain gage example for sensing compressive or tensile strain.

As shown in FIG. 2, the frame 18 may be attached to a mounting surface 64 through the use of a bracket 66, any suitable attachment means being provided.

The sensors 46–54 may be either tensile strain gages or compression strain gages, or similar load sensing transducers, depending upon their position. For example, illustrated in FIG. 2, the sensor 50 may be a tensile strain gage and the sensor 52 may be a compression strain gage. Again, positioning of the sensor determines the type of strain gage utilized.

For providing total analysis of loading, an anemometer 70 may be utilized for providing a wind signal corresponding to wind velocity and a rain sensor 72 utilized for producing a rain signal corresponding to precipitation, the controller being responsive to both a wind signal and a rain signal for confirming awning loading. A number of especially determined algorithms may be utilized for programming the controller to enable an environmentally responsive load detection system 10.

In addition, the controller 58 may be programmed so as to be responsive to the load signals for causing the motorized roller 12 to retract the fabric 26 to a partially retracted position illustrated in FIG. 1 in which the frame 18 and arms 36, 38 are able to withstand awning loading without damage. In addition, the controller 58 may be programmed to be further responsive to the load signals for causing the motorized roller 12 to extend the fabric 26 to a partially extended position, also shown in FIG. 1, at which the frame 18 and arms 36, 38 are able to withstand the awning 26 loading.

It should be also appreciated that with a multiplicity of sensors 46–54 which may be deployed in accordance with the system of the present invention, the controller 58 may be programmed to analyze the overall stress dynamic structure of the awning in a continuous manner.

Thus, for example, during extension or retraction of the fabric 26, if uneven loading signals are produced by the sensors or the pattern of loading is not in accordance with a predetermined pattern of loading, the controller can modify the speed of retraction or extension, stop operation of the system, or alternatively provide warning signals either on site or on a remote manner by a communication system, not shown. Such analysis is useful for maintenance of the awning system 10.

Although there has been hereinabove described a specific load detection system for motorized lateral and vertical arm awnings in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A load detection system for lateral and vertical arm awnings, the system comprising:

a motorized roller;

a fabric wound about the roller in a retracted position and extendable therefrom;

arms for supporting said fabric in an extended position;

a frame for supporting the roller;

bracket for mounting said frame to a support surface;

plurality of sensors for sensing strain in at least two of said bracket, frame, and arms due to extended awning loading, the sensors producing load signals corresponding to loading;

an anemometer for producing a wind signal corresponding to wind velocity a controller responsive to said load and wind signals for confirming awning loading and then causing said motorized roller to retract said fabric to a partially retracted position at which the frame and arms are able to withstand the awning loading without damage, said controller being further responsive to said load and wind signals for causing said motorized roller to extend said fabric to a partially extended position at which the frame and arms are able to withstand the awning loading.

2. The system according to claim 1 wherein said sensors comprise tensile strain gage.

3. The system according to claim 1 wherein said sensors comprise compression strain gage.

4. The system according to claim 1 further comprising a rain sensor for producing a rain signal corresponding to precipitation and said controller is responsive to said rain signal for confirming awning loading.

* * * * *